US007533905B2

(12) United States Patent
Jackson et al.

(10) Patent No.: US 7,533,905 B2
(45) Date of Patent: May 19, 2009

(54) ANTI-COUNTERFEITING SYSTEM AND METHOD

(75) Inventors: Warren Jackson, Palo Alto, CA (US); Ping Mei, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 922 days.

(21) Appl. No.: 11/144,203

(22) Filed: Jun. 2, 2005

(65) Prior Publication Data

US 2006/0273147 A1 Dec. 7, 2006

(51) Int. Cl.
*B42D 15/00* (2006.01)

(52) U.S. Cl. ..... 283/117

(58) Field of Classification Search ..... 235/379, 235/494; 283/117, 901, 902; 219/687, 761, 219/759, 634, 635, 448, 460.1, 121.36, 121.59, 219/121.52

See application file for complete search history.

(56) References Cited

U.S. PATENT DOCUMENTS 5,538,753 A 7/1996 Antes et al.
6,005,691 A * 12/1999 Grot et al. ..... 359/2
6,470,093 B2 10/2002 Liang
6,501,825 B2 12/2002 Kaiser et al.
6,603,871 B2 8/2003 Liang
6,744,909 B1 6/2004 Kostrzewski et al.
6,779,112 B1 8/2004 Guthery
2004/0002216 A1 1/2004 Taussig et al.

* cited by examiner

*Primary Examiner*—Dana Ross
*Assistant Examiner*—Pradeep C Battula

(57) ABSTRACT

Disclosed is an anti-counterfeiting system. In a particular embodiment, the anti-counterfeiting system has a first structure having a plurality of three-dimensional nanostructures, each having a height dimension less than a wavelength of visible light. In addition, there is a second structure having a second plurality of three-dimensional nanostructures, each having a height dimension less than a wavelength of visible light. The first and second structures are configured to couple together. An alignment mechanism is operable to align the first structure to the second structure and establish proximate contact between the first and second pluralities of nanostructures. With respect to the first and second structures, each encodes part of an authentication key. The authentication key includes pre-determined elements and interaction modalities. The resolution of the structures makes them copy-resistant. An associated method of use is also provided.

40 Claims, 6 Drawing Sheets

ANTI-COUNTERFEITING SYSTEM AND METHOD

FIELD OF THE INVENTION

This invention relates generally to security and anti-counterfeiting devices.

BACKGROUND OF THE INVENTION

Recently, there has been a growing need to develop systems and methods to combat counterfeit products. In the case of aircraft parts, drugs and food products such as baby formula, the consequences of counterfeit products can have devastating effects on health and equipment. Counterfeit national currency has also become a growing concern.

As recognizable as some brand names are with respect to general consumable products, unscrupulous parties commonly market counterfeit products to unknowing customers. There is lost revenue to the real Trademark/Trade Name holder when these counterfeit products are bought and sold. In addition, in the case of ink jet products or toner products for example, these counterfeit products often damage the systems into which they are placed. As the counterfeit was not realized, the real Trademark/Trade Name holder is often the party approached for repair or replacement, even though they were not the source of the counterfeit product.

Manufacturers of products have begun to incorporate systems and methods in an effort to thwart such counterfeit activity. Generally speaking, these systems and methods can be categorized into four basic groups:

1) Printed Materials such as, for example, hologram, fine patters of printed ink, watermarks and the like;
2) Printing Related Items such as, for example, inks that change color with the viewing angle, controlled sources of paper (e.g., currency paper) and the like;
3) Computer Systems such as special chips that are active or passive and wireless circuits; and
4) Control Numbers such as, for example, serial numbers that have some relation to the product or hash codes that are uniquely generated.

Anti-counterfeit measures generally attempt to address two elements: difficulty of forgery, in other words, a system or method that is difficult to forge; and ease of use—a system or method that is easily to use and/or recognize and verify. Ease of use is quite important as an effective method or system will typically be used by everyday people in everyday commerce with a wide range of skills in a variety of settings.

In many cases, the anti-counterfeit measure is meant to be optically detected, for example in the case of a dollar bill. Although the bill is printed on special paper with special ink and high resolution elements, optical dollar bill scanners often query only the image provided on the bill. A high-resolution photograph of a dollar bill may therefore be as acceptable to some optical scanning systems as a real dollar itself.

That a picture of a dollar bill may confuse an optical scanner but appear obviously different from a real dollar bill to a human observer highlights yet another consideration in anti-counterfeit technology. Namely, that detection by both persons and non-persons is frequently desired, but may be difficult to achieve.

When an anti-counterfeiting system and method are employed, the elements of the system are often analyzed and meticulously duplicated, such as in the case of holographic stickers or emblems. Originally, holographic emblems and stickers seemed ideal devices to indicate authenticity. However, as sophisticated technologies have advanced in micro-scale fabrication techniques, the ability to render counterfeit holograms has also advanced.

As a retort, attempts have been made to develop anti-counterfeit devices that are destroyed if removed from an authentic source, as is typically required for counterfeit duplication or use. Although somewhat effective, counterfeit duplication and use remains a concern.

The micro-miniaturization of electrical systems and electro-mechanical systems has advanced significantly. There is typically a high cost associated with micro-minaturization fabrication processes such as photolithography. Mass production, such as with roll-to-roll technology, can be difficult to achieve. Whereas a transistor or memory element at the heart of a component may justify the expense for a lithographic fabrication process, an anti-counterfeiting system or method affixed to an article of manufacture generally has not justified such expense Hence, there is a need for an anti-counterfeiting system and/or method that significantly thwarts duplication and counterfeiting while also being cost effective to manufacture, provide and utilize.

SUMMARY

This invention provides an anti-counterfeiting system.

In particular, and by way of example only, according to an embodiment, provided is an anti-counterfeiting system, including: a first structure having a first plurality of three-dimensional nanostructures each having a height dimension less than a wavelength of visible light; a second structure having a second plurality of three-dimensional nanostructures each having a height dimension less than a wavelength of visible light, the second plurality configured to couple with the first plurality; and an alignment mechanism, operable to align the first structure to the second structure and establish proximate contact between the first and second pluralities of three-dimensional nanostructures; wherein the first plurality of three-dimensional nanostructures encodes a first part of an authentication key, and wherein the second plurality of nanostructures encodes a second part of the authentication key, the authentication key including pre-determined elements and interaction modalities

DETAILED DESCRIPTION

Before proceeding with the detailed description, it is to be appreciated that the present teaching is by way of example, not by limitation. Thus, although the instrumentalities described herein are for the convenience of explanation shown and described with respect to exemplary embodiments, it will be appreciated that the principles herein may be equally applied in other types of anti-counterfeit devices. It will be appreciated that the drawings are not necessarily drawn to scale and may be expanded in certain aspects for ease of discussion.

Figure 1:
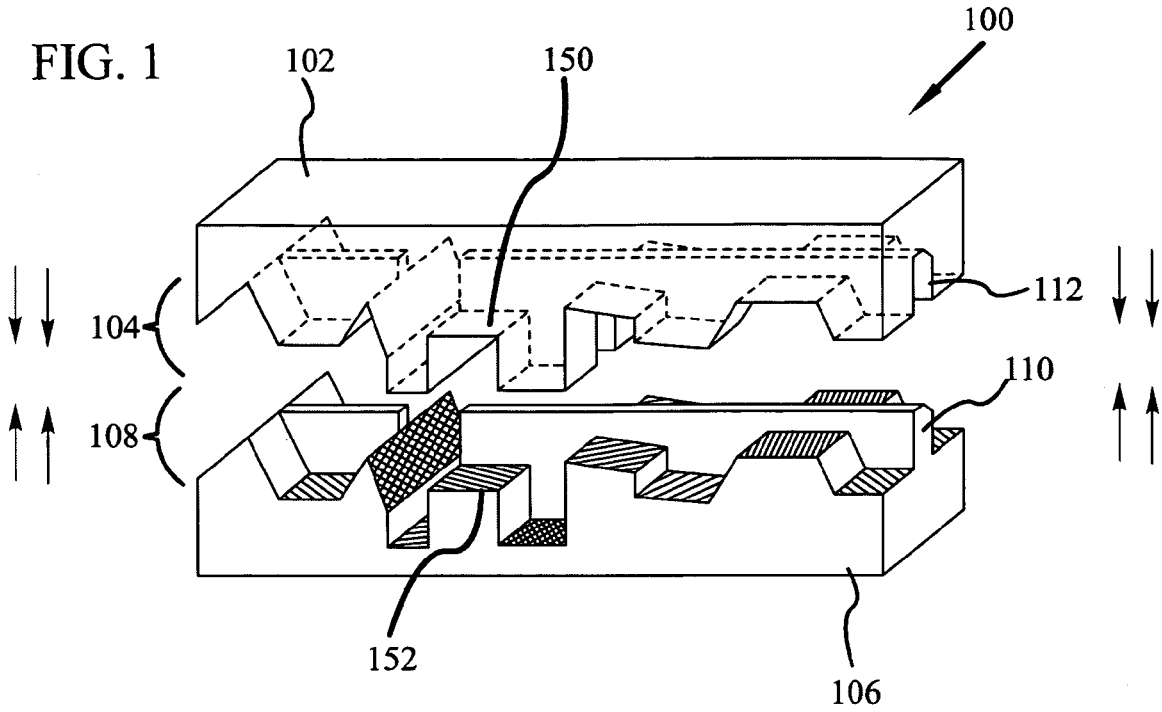
FIG. 1 a partial perspective view of primary components of an anti-counterfeiting system according to an embodiment.

Referring now to the drawings, and more specifically to FIG. 1, there is shown a portion of an anti-counterfeiting system (hereinafter "ACS") 100 in accordance with at least one embodiment. Moreover, as shown ACS 100 includes a first structure 102 having a first plurality of 3D nanostructures 104 and a second structure 106 having a second plurality of 3D nanostructures 108.

As illustrated, the second plurality of nanostructures 108 is configured to couple with the first plurality of nanostructures 104. As second structure 106 is exposed to the viewer, it may be further appreciated that each hatching pattern represents electrically distinct contacts. In the exemplary embodiment illustrated, a central ridge 110 on the second structure 106 aligns to a groove 112 in the first structure 102. Collectively, ridge 110 and groove 112 provide an alignment mechanism.

When the first and second structures 102, 106 are brought together and aligned, proximate contact between the first and second pluralities of nanostructures 104, 108 is established. Moreover, the configuration to couple first and second pluralities of nanostructures 104, 108 may be one of several forms, such as for example: physical contact, electrical contact, capacitive proximity, magnetic interaction, photoelectric contact, mechanical contact and/or combinations thereof.

Specifically, in at least one embodiment the proximate contact when coupled is physical contact between at least one nanostructure of the first plurality 104 and at least one nanostructure of the second plurality 108. In an alternative embodiment, the proximate contact when coupled is electrical contact between at least one nanostructure of the first plurality 104 and at least one nanostructure of the second plurality 108. In yet another alternative embodiment, the proximate contact when coupled is magnetic interaction, such as the magnetic alignment of one nanostructure of the first plurality 104, which may influence and/or interact with the magnetic alignment of one nanostructure of the second plurality 108.

In still another alternative embodiment, the proximate contact when coupled is mechanical, such as the deformation of at least one nanostructure by another, e.g., a cantilever nanostructure of the second plurality 108 deformed by a nanostructure of the first plurality 104. In an alternative embodiment, the proximate contact when coupled is photoelectric. Specifically, the materials forming the nanostructures of the first and second pluralities 104, 108 affect light passing through so as to generate a pre-determined response in a photoelectric element in the second structure 106.

In yet another alternative embodiment, the proximate contact when coupled is capacitive proximity between at least one nanostructure of the first plurality 104 and at least one nanostructure of the second plurality 108. In at least one embodiment, capacitive contact is the preferred form of proximate contact as the avoidance of direct contact reduces susceptibility to debris, stress and wear.

Further, in at least one alternative embodiment, the proximate contact when coupled may be a combination selected from physical contact, electrical contact and capacitive proximity between at least one nanostructure of the first plurality 104 and at least one nanostructure of the second plurality 108. In addition, so as to enhance the anti-counterfeit properties of the system, generally a plurality of nanostructures in the first and second pluralities of nanostructures 104, 108 achieve proximate contact. Moreover, when the first and second structures 102, 106 are aligned, the first and second pluralities of nanostructures 104, 108 provide unique geometric shapes and gaps. These shapes and gaps establish pathways with predetermined magnetic, photoelectric, conductive or capacitative values, and combinations thereof.

Figure 2:
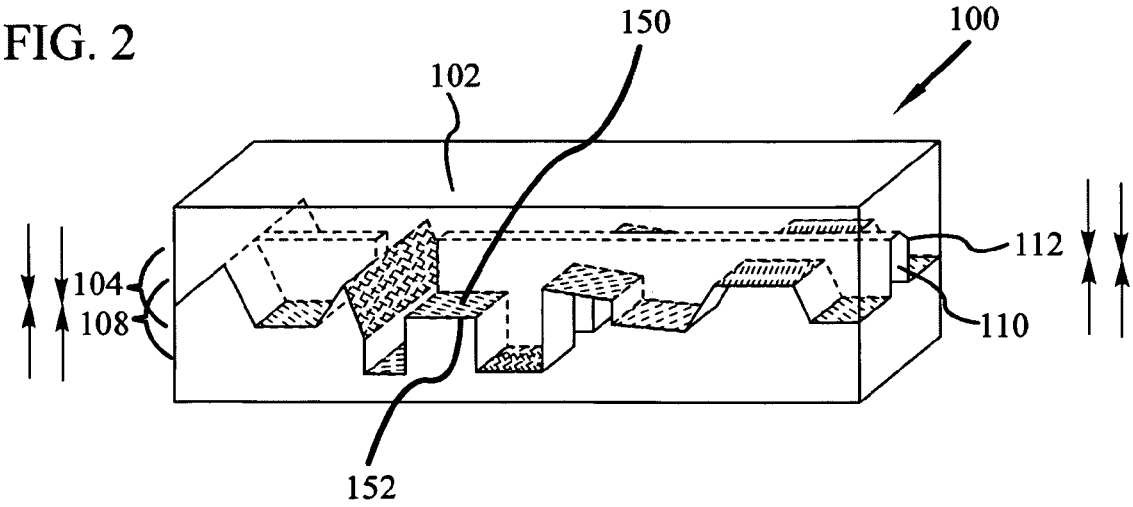
FIG. 2 is a partial perspective view of the anti-counterfeiting system of FIG. 1 showing the components in proximate contact.

As shown in FIG. 2, physical and/or electrical proximate contact has been established between the illustrated first and second pluralities of nanostructures 104, 108. With respect to both FIGS. 1 and 2, each nanostructure may be an electrically distinct contact, an electrical device (e.g., a TFT, tunnel junction memory, etc.), or a portion of an electrical device.

For example, in at least one embodiment, a nanostructure on first structure 102 provides the gate electrode for a nanostructure on second structure 106, providing a source, drain and channel. In another embodiment, nanostructures on first structure 102 provide a capacitor and corresponding nanostructures on second structure 106 provide a inductor. Proximate contact between the inductor and capacitor causes the whole to form a tank circuit with desired oscillation frequencies.

Moreover, in at least one embodiment, the first plurality of three-dimensional nanostructures 104 encodes a first part of an authentication key and the second plurality of nanostructures encodes a second part of an authentication key.

When coupled, the first and second pluralities of nanostructures 104, 108 provide a complete authentication key. Specifically, in at least one embodiment, when coupled to provide proximate contact, the first and second pluralities of nanostructures 104, 108 interact using pre-determined elements and interaction modalities. More specifically, the elements include pre-determined physical geometry. The modalities include, but are not limited to, electrical conduction, magnetic interaction, photoelectric interaction, mechanical operation and/or combinations thereof. If the physical geometry does not align, the other involved elements and/or modalities will not function.

For example, when formed of specifically different materials, the electrically conductive properties of the nanostructures may be selectively chosen so as to provide a unique electrical signal. By combining physical geometry with electrical conduction, the level of complexity of the device may be advantageously elevated.

In at least one embodiment, the coupled nanostructures provide a tunnel junction memory cell. More specifically, nanostructure 150 on first structure 102 may provides a ferromagnetic layer with a known orientation and a tunnel junction layer as a cap layer on the distal end of nanostructure 150. Mating nanostructure 152 on second structure 106 provides a ferromagnetic layer with a known orientation. When coupled, the known orientations (e.g., parallel or anti-parallel) will impose a detectable level of resistance upon a current tunneling through the coupled structure.

This detected resistance may be converted to a binary value such as a data "1" or a data "0". In an embodiment wherein a plurality of coupled nanostructures provide magnetic tunnel junctions or other resistive tunnel junctions, a binary code may be pre-encoded as an element of the anti-counterfeiting system. Such a binary code may be a digital fingerprint.

As used herein, the term "digital fingerprint" is applied to a unique cryptographic hash such as, for example, an MD5 hash. A digital fingerprint may also be referred to as a message digest. With a cryptographic hash, the security properties ensure that the fingerprint is random to prospective attackers and does not leak or hint any information about the message itself such as, for example, an authorization code, serial number, activation key or the like. In addition, no other different message will provide the same digital fingerprint.

Any change to the message, even a single bit change, will result in a dramatically different hash, and any change to the hash, even a single bit change, will result in a dramatically different message. The following example demonstrates this characteristic when performing an MD5 hash. In the second instance the letter "d" is changed to a "c".

MD5 (Message Digest Algorithm 5) Example

MD5("The quick brown fox jumps over the lazy dog") =9e107d9d372bb6826bd81d3542a419d6

MD5("The quick brown fox jumps over the lazy cog") =1055d3e698d289f2af8663725127bd4b A cryptographic hash is considered secure if it is not computationally feasible to determine the content of the message from the hash, and/or to find instances where two or more different messages have the same hash value. In at least one embodiment, such a cryptographic hash is encoded in ACS 100 as the electrical conduction properties established by proximate alignment between the first and second pluralities of nanostructures 104, 108.

In at least one embodiment, either the first structure 102 or the second structure 106 is connected to a power source sufficient to enable the electrical components of ACS 100. In addition, in at least one embodiment, a suitable controller may be electrically coupled to the first structure 102 as well. A suitable controller may be comprised of analog circuitry, a digital processor, a CPU programmed with control logic, a device driver and combinations thereof. Under appropriate circumstances, the controller, or portions of the controller, may be integrated with the first structure 102. It is of course understood and appreciated that a power source and/or controller may be coupled to the second structure 106 in addition to, or in place of, such connections to the first structure 102.

As indicated by the choice of terms, the first and second pluralities of nanostructures 104, 108 are exceedingly small. More specifically, the nanostructures each have height and width dimensions of between about 0.5 to 5 μm. Moreover, in at least one embodiment, each nanostructure member of the first and second pluralities of nanostructures 104, 108 has a height dimension less than a wavelength of visible light. As such, the first and second pluralities of nanostructures 104, 108 advantageously can not be photographed or optically detected. Such fine resolution of the first and second pluralities of nanostructures 104, 108 prohibits reproduction as counterfeiters likely do not have the highly sophisticated fabrication technology necessary to render first and second pluralities of nanostructures 104, 108. In addition, such fine resolution renders the first and second pluralities of nanostructures 104, 108 difficult to detect visually, or to identify such structures as necessary security structures. Enabled by the small size, the creation of hidden and not easily detectable security structures greatly complicates counterfeiting.

In addition, attempts to use either the first structure 102 or the second structure 106 as a template for a counterfeit component is thwarted by the small scale of the structures and their nearly certain destruction. Stated more simply, the structures are small enough to function, but too small to survive dissection. Specifically, the first and second pluralities of nanostructures 104, 108 are copy-resistant.

Moreover, any attempt to separate the first or second pluralities of nanostructures 104, 108 from either the first or second structure 102, 106 will result in the destruction of the nanostructures. In other words, the components of ACS 100 are operationally inseparable, for attempts to separate the nanostructures from their respective first or second structures will render the ACS 100 inoperable. Such inoperability and copy-resistance may be advantageous in thwarting attempts to counterfeit ACS 100.

Figure 3:
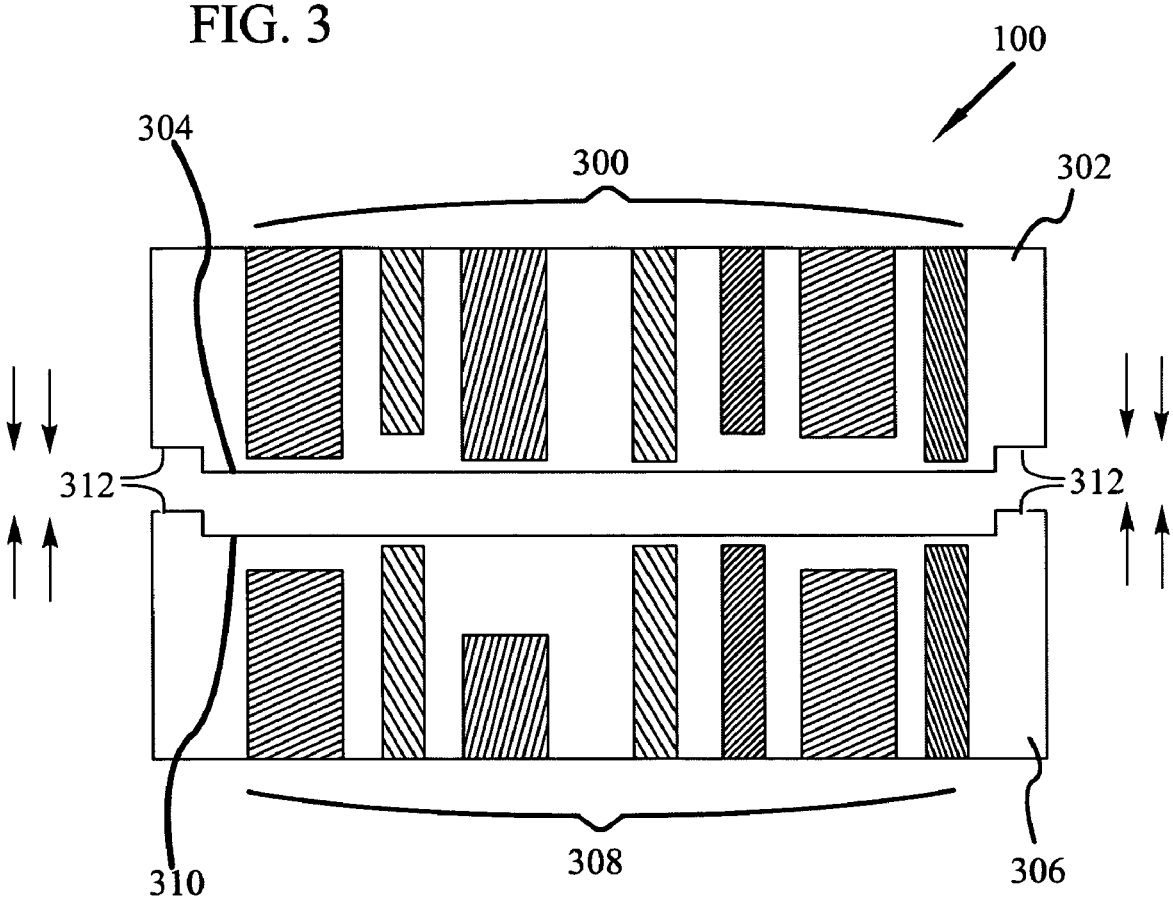
FIG. 3 is a an alterative embodiment of the primary components of an anti-counterfeiting system.

FIG. 3 illustrates an alternative ACS 100 embodiment wherein the first plurality of nanostructures 300 are hidden within first structure 302, e.g., below surface 304. Likewise, the second plurality of nanostructures 308 are hidden within second structure 306, e.g., below surface 310. In at least one embodiment, pluralities of nanostructures 300 and 308 are understood to be substantially identical to nanostructures 104 and 108 described above In at least one embodiment, where surfaces 304 and 310 are solid, when the first and second structures 302, 306 are brought together and aligned by alignment guides 312, the first and second pluralities of nanostructures 300, 308 couple by capacitive proximity. In such an embodiment, not only does the nano-scale size of the first and second pluralities of nanostructures 300, 308 render them hidden from visual observation, but they are also concealed by the material forming surfaces 304 and 310.

In at least one alternative embodiment, surfaces 304 and 310 provide a plurality of apertures to permit the first and second pluralities of nanostructures 300, 308 to move and establish proximate contact in accordance with at least one modality introduced above when the first and second structures 302, 306 are brought together and aligned by alignment guides 312. In such an embodiment, the nano-scale size of the first and second pluralities of nanostructures 300, 308 again renders them hidden from visual observation. In addition, when the first and second structures 302, 306 are not brought together the first and second pluralities of nanostructures 300, 308 are hidden below the surfaces 304 and 310.

Figure 4:
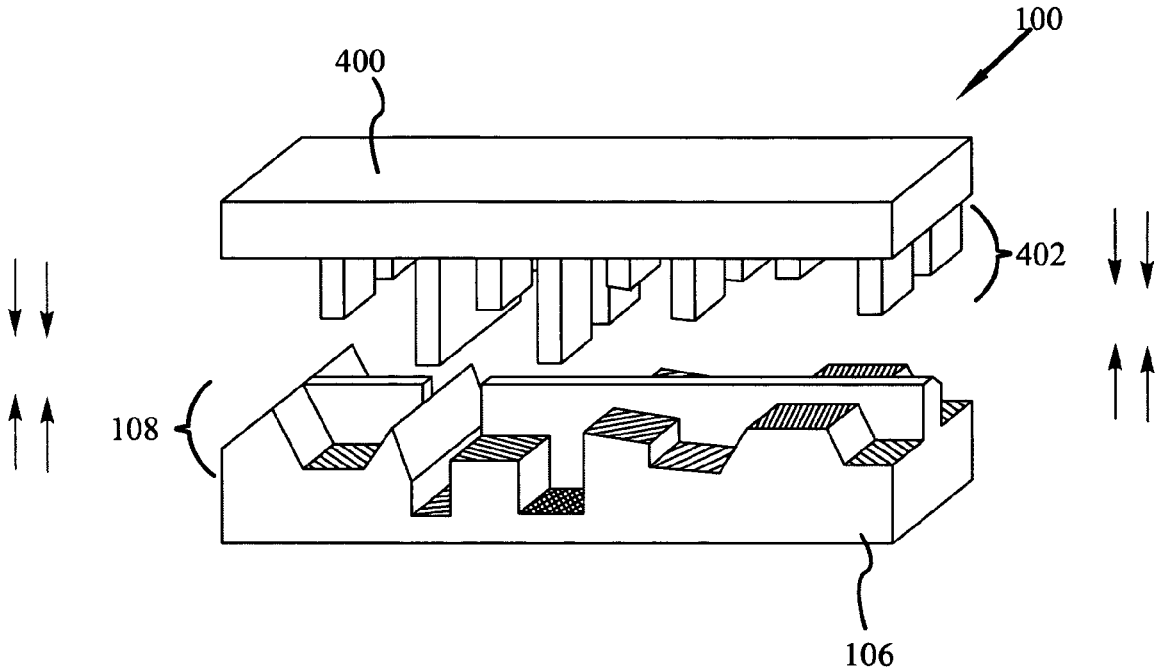
FIG. 4 is a progressive illustration of the compliant primary components providing a temporal pattern of proximate contact.

FIG. 4 illustrates an alternative ACS 100 embodiment wherein the first structure 400 provides a first plurality of three-dimensional nanostructures 402 that are not mirror copies of the second plurality of three dimensional nanostructures 108 provided by second structure 106. The first plurality of nanostructures 402 and second plurality of nanostructure 108 are still configured to couple when the first and second structures 400, 106 are brought together and aligned. As in the ACS 100 embedment depicted in FIGS. 1~3, if appropriate proximate contact in the form of electrical, physical and/or capacitive proximity is established, verification of authenticity is achieved.

In at least one embodiment, at least a portion of the first and second pluralities of nanostructures 104, 108, 402 are formed from compliant materials. Specifically, the material may be compressed when the first and second structures are brought together and aligned. Most plastics and polymers are compliant. A very compliant material appropriate for use in at least one embodiment is Polydimethylsiloxane elastomer, more commonly referred to simply as "PDMS".

Figure 5:
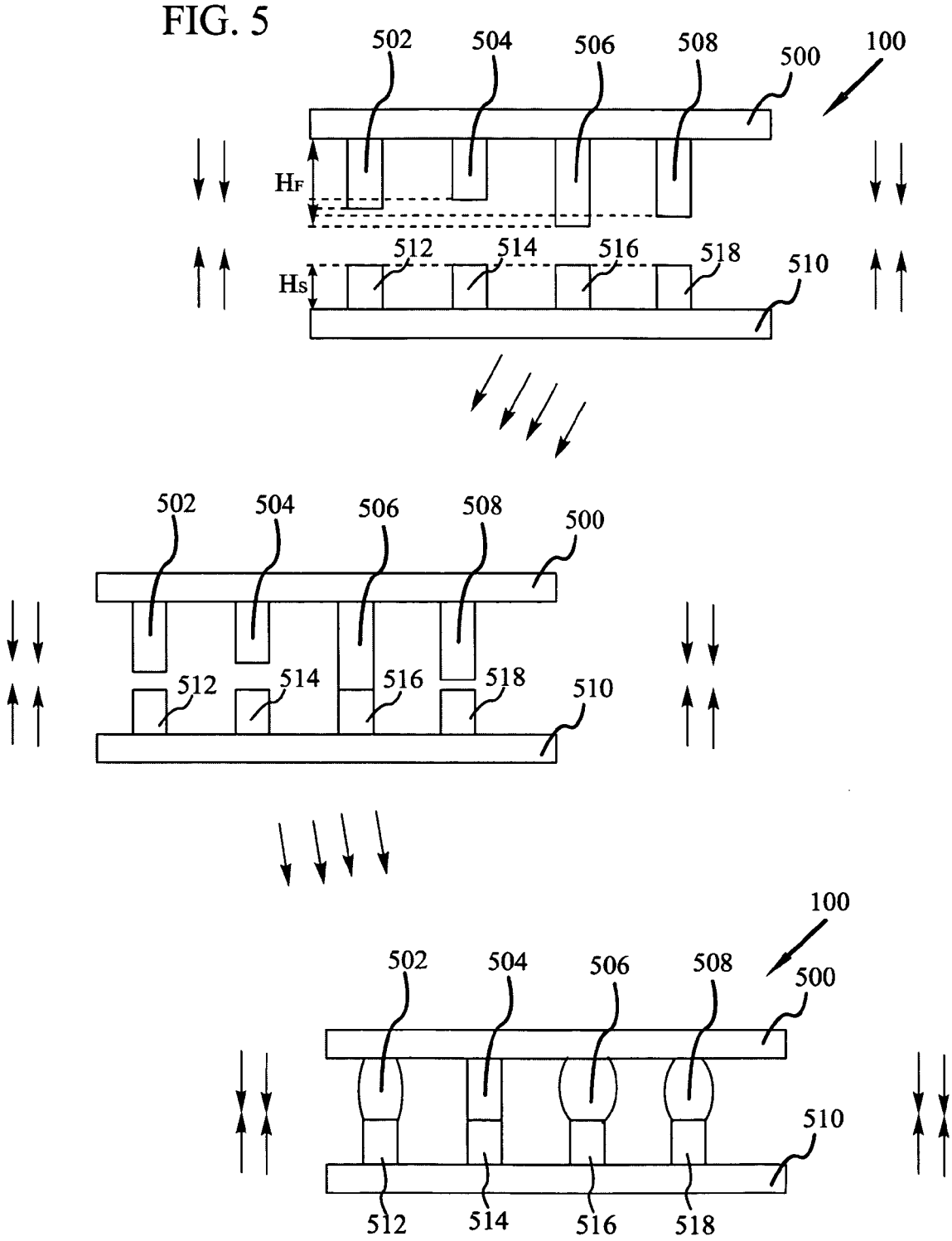
FIG. 5 illustrates a temporal pattern of proximate contact employed in at least one embodiment of an anti-counterfeiting system.

FIG. 5 illustrates a temporal pattern that is employed in at least one embodiment, in addition to the elements of physical geometry and electrical conduction so as to provide an advantageous ACS 100. For ease of discussion and illustration, in FIG. 5, first structure 500 is shown having a first plurality of three-dimensional nanostructures, specifically, four nanostructures 502~508. Each nanostructure 502~508 has is shown as having a different height "$H_F$". Second structure 510 is shown having a second plurality of three-dimensional nanostructures, specifically four nanostructures 512~518. Each nanostructure 512~418 is shown as having substantially the same height "$H_S$".

As the first and second structures 500, 510 are brought together, the first instance of proximate contact is between nanostructures 506 and 516. The second instance of proximate contact is between nanostructures 508 and 518. The third instance of proximate contact is between nanostructures 502 and 512. The final instance of proximate contact is between nanostructures 504 and 514.

The compliant nature of nanostructures 502~508 is demonstrated with slight bulging of nanostructures 502, 506 and 508. Although not illustrated, it is of curse understood and appreciated that nanostructures 512~518 may also be compliant.

In at least one embodiment, the temporal pattern in which proximate contact is established is used to establish a specific electrical patter or circuit within ACS 100. For example, the first instance of proximate contact between nanostructures 508 and 518 may establish a transistor which permits a flow of current that would not occur if nanostructures 508 and 518 were not the first to establish proximate contact.

Figure 6:
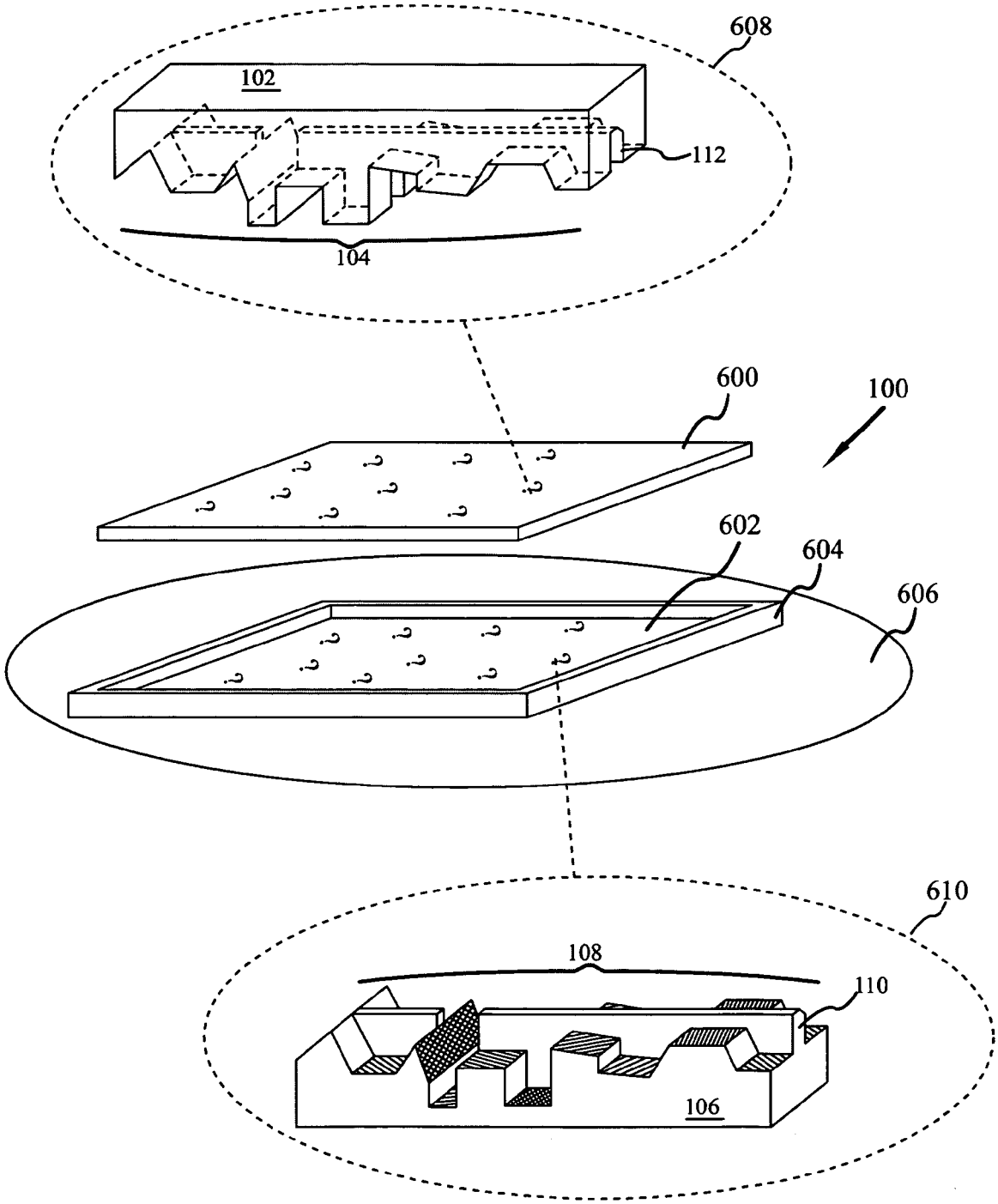
FIG. 6 is a partial perspective view in human scale of the primary components of the anti-counterfeiting system shown in FIG. 1.

FIG. 6 further illustrates the hidden nature of at least one embodiment of ACS 100. Shown is a first structure 600, a second structure 602 and a human scale alignment device 604. Second structure 602 and human scale alignment device 604 are joined to the surface of an article of manufacturer 606. While a user may see, touch, hold and otherwise use first and second structures 600, 602, and may even know that they employ first and second pluralities of nanostructures (e.g., 104, 108 shown in dotted enlarged portions 608 and 610, respectively), the location of these structures is hidden and unknown to the user.

The hidden nature of the nanostructures may be due simply to their minute size as discussed above, or may additionally be enhanced by placing them below the surface of each structure. In at least one embodiment, a plurality of different locations of nanostructures may be provided; however, only a subset are truly involved in the anti-counterfeiting system.

As illustrated in FIGS. 1~4 an alignment device may be incorporated as part of the first and second structures (e.g., 102 106). As shown in FIG. 6, a human scale alignment device may also be employed. Various human scale alignment devices are known that permit micron and submicron alignment. It is also understood and appreciated that in an ACS 100 embodiment relying on capacitive proximity, magnetic and/or photoelectric effect without physical contact between the nanostructures, proper alignment may be necessary for only a brief period of time, thus permitting a user to slide one structure past the other.

One such human scale alignment mechanism is a called a kinematic mount. It consists of three hard metallic spherical surfaces (for example, ball bearings) affixed rigidly to one surface. The mating surface contains v-grooves oriented in different directions that match the spherical surfaces. In the proper position the ball touches both sides of the v-groove. If the first surface is offset with respect to the second, the spherical surface only contacts one side of the v-groove and provides a force to move the relative position of the surfaces to the proper alignment. Such systems are capable of repeatable submicron alignment of the two surfaces. In at least one embodiment, ACS 100 employs a Kinematic mount as the alignment mechanism.

So as to provide authentication and thwart counterfeiting, in at least one embodiment, the first structure 102 is affixed to an article of manufacturer. Such an article may be packaging containing a product, or it may be a product itself such as, but not limited to, an ink or toner cartridge. In at least one embodiment, the first structure 102 provides an adhesive layer on the side opposite from the first plurality of nanostructures 104. As such, the first structure 102 may be affixed to products, packages, printed materials, or other items.

In at least one embodiment, ACS 100 is provided by processes including Self-Aligned Imprint Lithography ("SAIL"), a recently developed technique for producing multilayer patterns on flexible substrates. The basics of this process are set forth and described in U.S. patent application Ser. No. 10/104,567, entitled "Method and System for Forming a Semiconductor Device" published as U.S. Patent Publication Number 20040002216, the disclosure of which is incorporated herein by reference.

The SAIL technique uses a 3D patterned resist and is typically employed in roll-to-roll processing. As the 3D resist is flexible, the pattern will stretch or distort to the same degree as the substrate. As such, a SAIL roll-to-roll fabrication process may be employed to provide low cost manufacturing solutions for devices such as flat and/or flexible displays, or other devices suitable for roll-to-roll processing.

Utilizing height differences in an imprinted 3D stamp or other provided 3D structure, multi-level pattern information is provided and self-alignment maintained independent of the instability of a flexible substrate. It shall also be realized that the disclosed method may be employed upon a non-flexible substrate while remaining within the spirit and scope of at least one embodiment.

Fabrication of ACS 100 may also involve the process set forth and described in U.S. patent application Ser. No. 11/062,384, entitled "A Method for Forming an Electronic Device", the disclosure of which is incorporated herein by reference. Briefly stated, U.S. patent application Ser. No. 11/062,384 combines imprint lithography with manufacturing patterning techniques of printing, imprinting, embossing, laser scanning, and combinations thereof for fabrication processes which may be performed in a roll-to-roll environment.

It is of course understood and appreciated that such fabrication processes will provide the first plurality of nanostructures 104 and the second plurality of nanostructures 106, the two pluralities so configured to couple by physical contact, electrical contact, capacitive proximity and/or combinations thereof. Despite the small scale advantageously employed in ACS 100, the roll-to-roll processes permit fabrication of physically separate components with appropriate tolerances to establish proximate contact. For example, in at least one embodiment, tolerances of about 0.1 to 10 microns are sufficient.

Roll-to-roll technology, also referred to as web fabrication, is a relatively new technology for the large scale production of nano-scale structures. The capital investment and tooling required to establish a roll-to-roll process is significant and generally only available to large scale manufacturers producing a high volume of products. As such, investment in roll-to-roll technology for the simple purpose of fabricating counterfeit versions of the devices herein described is advantageously unlikely. Moreover, even with roll-to-roll technology, without prior knowledge of the electrical conduction elements of the ACS 100, structural fabrication will not suffice to provide a working counterfeit device.

Having described the above structural embodiments of ACS 100, an alternative embodiment with respect to an anti-counterfeiting method will now be described with reference to the flow diagram of FIG. 7. It will be appreciated that the described events and method of operation need not be performed in the order in which they are herein described, but that this description is merely exemplary of one method of operation in accordance with at least one embodiment.

Figure 7:
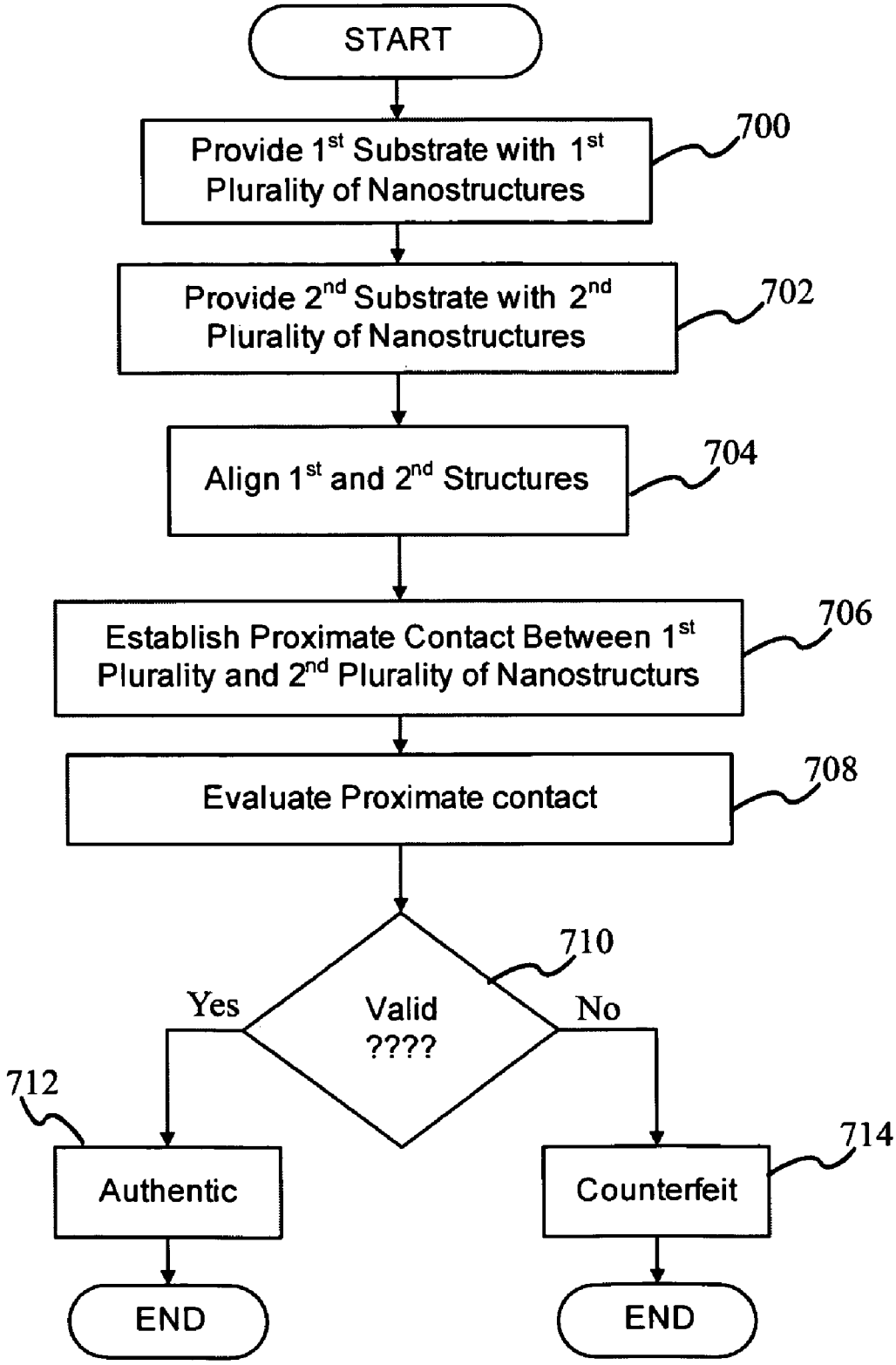
FIG. 7 is a high level flow diagram illustrating an anti-counterfeiting method according to an embodiment.

With respect to FIG. 7, in at least one embodiment, the anti-counterfeiting method commences by providing a first structure having a first plurality of three-dimensional nanostructures, block 700. A second structure having a second plurality of three-dimensional nanostructures configured to couple with the first plurality is also provided, block 702. In at least one embodiment, either the first or second structure is affixed to an article of manufacturer, for example, the first structure may be affixed to a product packaging or the physical product itself.

A user wishing to verify the article of manufacturer as non-counterfeit then aligns the second structure to the first structure, block 704. This alignment establishes proximate contact between the first and second pluralities of nanostructures, block 706. An evaluation is then performed to evaluate at least one instance of proximate contact between a first and second nanostructure to verify non-counterfeit status, block 708. In at least one embodiment, such evaluation includes measuring electrical capacitance and/or confirming electrical contact between the nanostructures.

Assuming that the second structure is affixed to an article of manufacture and the first structure is under the control of a user, the evaluation process determines the validity, or non-counterfeit status of the article of manufacturer, decision 710. In other words, if the evaluation is positive, the user is informed that the article of manufacture is authentic, 712. If the evaluation is negative, the user is informed that the article of manufacture is counterfeit, block 714.

In at least one embodiment, the notification is a simple light, e.g., red or green. In alternative embodiments, more complex and/or complete visual information, auditory information, or electrical enabling of functionality forms of notification may be employed. One variation advantageously different from typical lock and key systems is that one party, such as a merchant, could be informed about the counterfeit nature without alerting the party passing the counterfeit item. This would enable tracing of the counterfeiting to the source without tipping off the counterfeiter.

In an embodiment wherein the first structure is physically on a product (e.g., an ink or toner cartridge), and the evaluation is performed by a controller within the printer, an action is initialized based on the evaluated status. More simply stated, if the evaluation is not confirmed, the printer will not print, as the provided ink or toner is evaluated as counterfeit.

Changes may be made in the above methods, systems and structures without departing from the scope hereof. It should thus be noted that the matter contained in the above description and/or shown in the accompanying drawings should be interpreted as illustrative and not in a limiting sense. The following claims are intended to cover all generic and specific features described herein, as well as all statements of the scope of the present method, system and structure, which, as a matter of language, might be said to fall therebetween.

What is claimed is:

1. An anti-counterfeiting system, comprising:

a first structure having a first plurality of three-dimensional nanostructures each having a height dimension less than a wavelength of visible light;

a second structure having a second plurality of three-dimensional nanostructures each having a height dimension less than a wavelength of visible light, the second plurality configured to couple with the first plurality; and an alignment mechanism, operable to align the first structure to the second structure and establish proximate contact between the first and second pluralities of three-dimensional nanostructures;

wherein the first plurality of three-dimensional nanostructures encodes a first part of an authentication key, and wherein the second plurality of nanostructures encodes a second part of the authentication key, the authentication key including pre-determined elements and interaction modalities.

2. The anti-counterfeiting system of claim 1, wherein the first and second pluralities of three-dimensional nanostructures have hidden locations unknown to a user.

3. The anti-counterfeiting system of claim 1, wherein the first and second pluralities of three-dimensional nanostructures are copy-resistant.

4. The anti-counterfeiting system of claim 1, wherein the first and second pluralities of three-dimensional nanostructures have a size resolution that prohibits reproduction.

5. The anti-counterfeiting system of claim 1, wherein the second structure is disposed upon an article of manufacture.

6. An anti-counterfeiting system, comprising:

a first structure having a first plurality of hidden three-dimensional nanostructures;

a second structure having a second plurality of hidden three-dimensional nanostructures, the second plurality configured to couple with the first plurality; and an alignment mechanism, operable to align the first structure to the second structure and establish proximate contact between the first and second pluralities of hidden three-dimensional nanostructures.

7. The anti-counterfeiting system of claim 6, wherein the second structure is disposed upon an article of manufacture.

8. The anti-counterfeiting system of claim 6, wherein the first and second pluralities of hidden three-dimensional nanostructures are copy-resistant.

9. The anti-counterfeiting system of claim 6, wherein the first and second pluralities of hidden three-dimensional nanostructures have a size resolution that prohibits reproduction.

10. The anti-counterfeiting system of claim 6, wherein locations of the first and second pluralities of hidden three-dimensional nanostructures are unknown to a user.

11. The anti-counterfeiting system of claim 6, wherein the configuration to couple is selected from capacitive proximity, electrical contact, physical contact, magnetic interaction, photoelectrical interaction and combinations thereof.

12. The anti-counterfeiting system of claim 6, wherein the first and second pluralities of hidden three-dimensional nanostructures are formed from compliant materials.

13. The anti-counterfeiting system of claim 12, wherein the compliant materials deform to provide a temporal pattern as proximate contact between nanostructures of the first and second pluralities of hidden three-dimensional nanostructures occurs.

14. The anti-counterfeiting system of claim 6, wherein the first plurality of hidden three-dimensional nanostructures encodes a first part of an authentication key, and wherein the second plurality of hidden three-dimensional nanostructures encodes a second part of the authentication key, the authentication key including pre-determined elements and interaction modalities.

15. The anti-counterfeiting system of claim 6, wherein the second structure is affixed to an article of manufacturer.

16. An anti-counterfeiting system, comprising:

a first structure having a first plurality of copy-resistant three-dimensional nanostructures;

a second structure having a second plurality of copy-resistant three-dimensional nanostructures, the second plurality configured to couple with the first plurality; and an alignment mechanism, operable to align the first structure to the second structure and establish proximate contact between the first and second pluralities of copy-resistant three-dimensional nanostructures.

17. The anti-counterfeiting system of claim 16, wherein the first and second pluralities of copy-resistant three-dimensional nanostructures have a size resolution that prohibits reproduction.

18. The anti-counterfeiting system of claim 16, wherein the first and second pluralities of copy-resistant three-dimensional nanostructures have hidden locations unknown to a user.

19. The anti-counterfeiting system of claim 16, wherein the configuration to couple is selected from capacitive proximity, electrical contact, physical contact, magnetic interaction, photoelectrical interaction and combinations thereof.

20. The anti-counterfeiting system of claim 16, wherein the first and second pluralities of copy-resistant three-dimensional nanostructures are formed from compliant materials.

21. The anti-counterfeiting system of claim 20, wherein the compliant materials provide a temporal pattern as proximate contact between copy-resistant three-dimensional nanostructures of the first and second pluralities of nanostructures occurs.

22. The anti-counterfeiting system of claim 16, wherein the first plurality of copy-resistant three-dimensional nanostructures encodes a first part of an authentication key, and wherein the second plurality of copy-resistant three-dimensional nanostructures encodes a second part of the authentication key, the authentication key including pre-determined elements and interaction modalities.

23. The anti-counterfeiting system of claim 16, wherein the second structure is affixed to an article of manufacturer.

24. An anti-counterfeiting system, comprising:

a first structure having a first plurality of hidden, copy-resistant three-dimensional nanostructures;

a second structure having a second plurality of hidden, copy-resistant three-dimensional nanostructures, the second plurality configured to couple with the first plurality; the second structure disposed upon an article of manufacturer; and an alignment mechanism, operable to align the first structure to the second structure and establish proximate contact between the first and second pluralities of hidden, copy-resistant three-dimensional nanostructures.

25. The anti-counterfeiting system of claim 24, wherein the article of manufacturer is selected from a package, a case, an ink cartridge, a toner cartridge, a food product, or combinations thereof.

26. The anti-counterfeiting system of claim 24, wherein the resolution of the first and second pluralities of hidden, copy-resistant three-dimensional nanostructures prohibits reproduction.

27. The anti-counterfeiting system of claim 24, wherein each nanostructure of the first and second pluralities of hidden, copy-resistant three-dimensional nanostructures has a height less than a wavelength of visible light.

28. The anti-counterfeiting system of claim 24, wherein locations of the first and second pluralities of hidden, copy-resistant three-dimensional nanostructures are unknown to a user.

29. The anti-counterfeiting system of claim 24, wherein the configuration to couple is selected from capacitive proximity, electrical contact, physical contact, magnetic interaction, photoelectrical interaction and combinations thereof.

30. An anti-counterfeiting method, comprising:

providing a first structure having a first plurality of three-dimensional nanostructures;

providing a second structure having a second plurality of three-dimensional nanostructures, the second plurality configured to couple with the first plurality;

aligning the first structure to the second structure, the alignment providing proximate contact between the first and second pluralities of three-dimensional nanostructures; and evaluating at least one instance of proximate contact between a first and second nanostructure to verify non-counterfeits status.

31. The anti-counterfeiting method of claim 30, wherein the first and second pluralities of three-dimensional nanostructures are copy-resistant.

32. The anti-counterfeiting method of claim 30, wherein the first and second pluralities of three-dimensional nanostructures are hidden.

33. The anti-counterfeiting method of claim 30, wherein the first and second pluralities of three-dimensional nanostructures have a size resolution that prohibits reproduction.

34. The anti-counterfeiting method of claim 30, wherein aligning the second structure to the first structure provides unique geometric shapes and gaps as the first and second pluralities of three-dimensional nanostructures couple, the shapes and gaps establishing pathways with predetermined magnetic, photoelectric, conductive, capacitance values and/or combinations thereof.

35. The anti-counterfeiting method of claim 30, wherein at least one nanostructure is formed from a compliant material.

36. The anti-counterfeiting method of claim 35, wherein the compliant material permits a temporal pattern of proximate contact as the second structure is aligned to the first structure.

37. The anti-counterfeiting method of claim 30, wherein evaluating at least one instance of proximate contact between a first and second nanostructure includes measuring electrical capacitance.

38. The anti-counterfeiting method of claim 30, wherein evaluating at least one instance of proximate contact between a first and second nanostructure includes confirming electrical contact.

39. The anti-counterfeiting method of claim 30, wherein the first plurality of three-dimensional nanostructures encodes a first part of an authentication key, and wherein the second plurality of three-dimensional nanostructures encodes a second part of the authentication key, the authentication key including pre-determined elements and interaction modalities.

40. The anti-counterfeiting method of claim 30, further including initializing an action based on evaluated status.

* * * * *